United States Patent [19]

Lewandowski et al.

[11] Patent Number: 4,673,778

[45] Date of Patent: Jun. 16, 1987

[54] SNAP ACTION SWITCH

[75] Inventors: Raymond F. Lewandowski, Mount Prospect; Jacek P. Doros, Highwood; William H. Redfield, Lake Forest, all of Ill.

[73] Assignee: The Cherry Corporation, Waukegan, Ill.

[21] Appl. No.: 698,436

[22] Filed: Feb. 5, 1985

[51] Int. Cl.[4] ..... H01H 21/04

[52] U.S. Cl. ..... 200/67 B; 200/284; 200/332; 29/622

[58] Field of Search ..... 200/67 B, 67 D, 332, 200/284; 29/622

[56] References Cited

U.S. PATENT DOCUMENTS

| | | | |
|---|---|---|---|
| 2,800,546 | 7/1957 | Reitler | 200/67 B |
| 3,141,075 | 7/1964 | Brevick et al. | 200/67 |
| 3,163,741 | 12/1964 | Bury | 200/67 D |
| 3,263,306 | 8/1966 | Chapin et al. | 29/622 |
| 3,317,688 | 5/1967 | Cherry et al. | 200/67 B |
| 3,652,811 | 3/1972 | Barney | 200/284 |
| 4,453,062 | 6/1984 | Brown et al. | 200/332 |

*Primary Examiner*—Stephen Marcus
*Assistant Examiner*—Linda J. Sholl
*Attorney, Agent, or Firm*—Willian Brinks Olds Hofer Gilson & Lione Ltd.

[57] ABSTRACT

A sub-miniature snap-action switch which can be manufactured efficiently and reliably with minimal reliance on tedious hand assembly. The switch includes a novel pivot bracket assembly comprising a pivot bracket, a blade and a spring coupling the bracket to the blade.

11 Claims, 12 Drawing Figures

FIG. 4
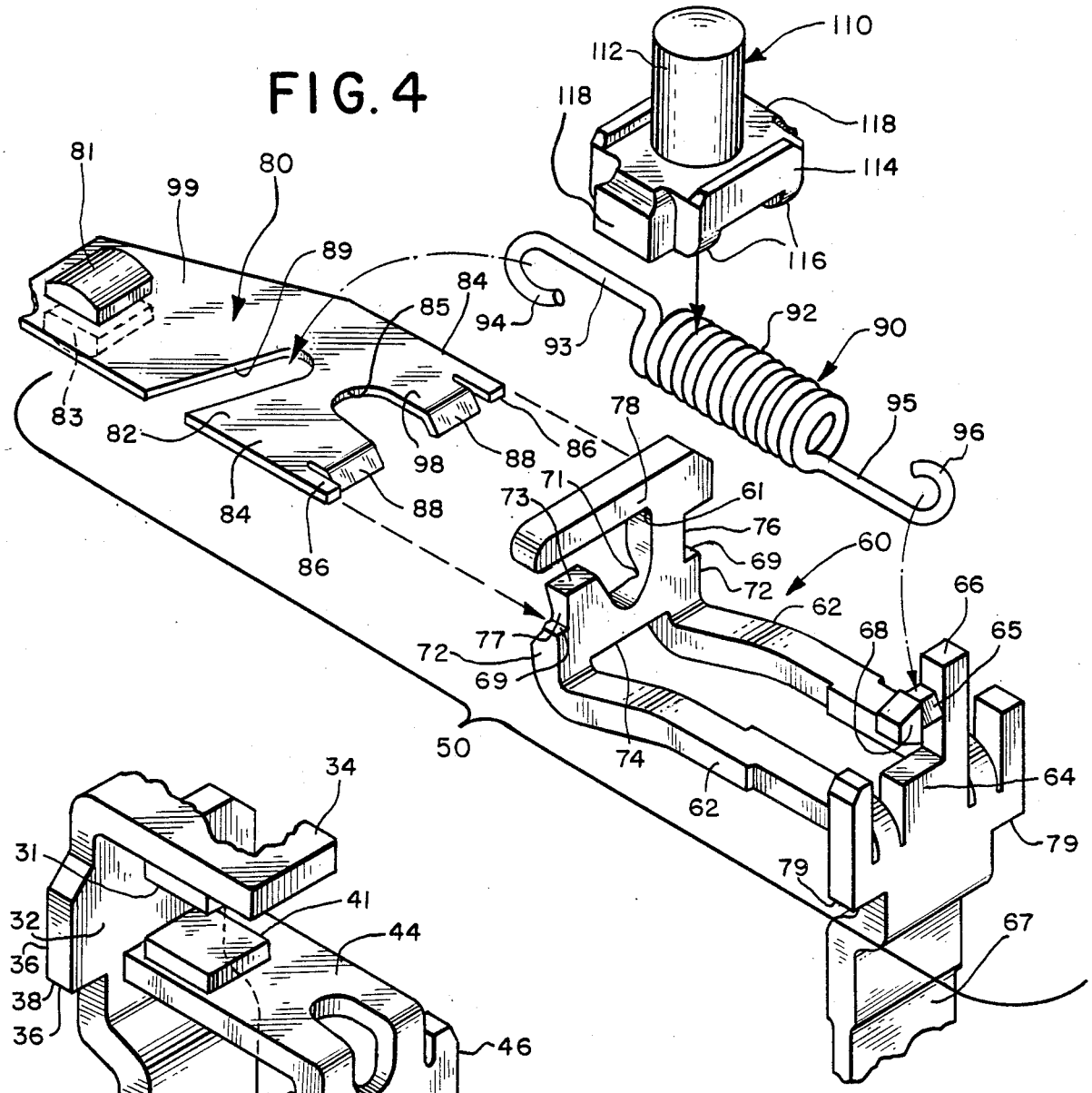
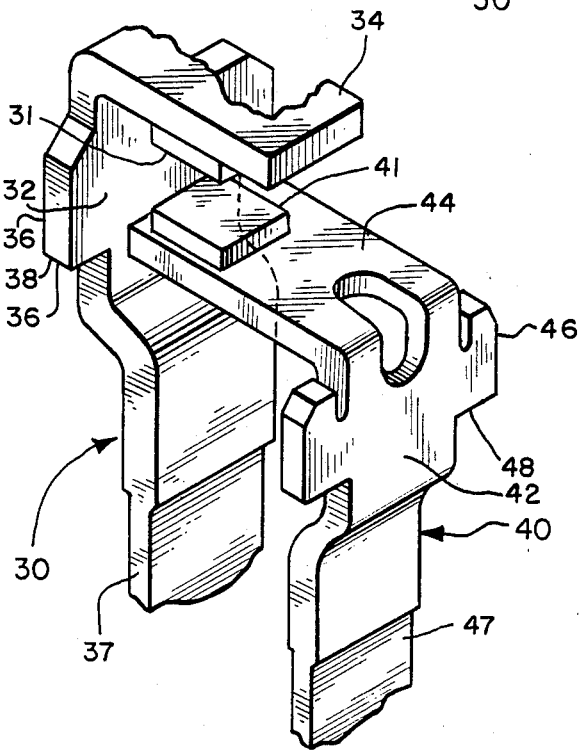
FIG. 5
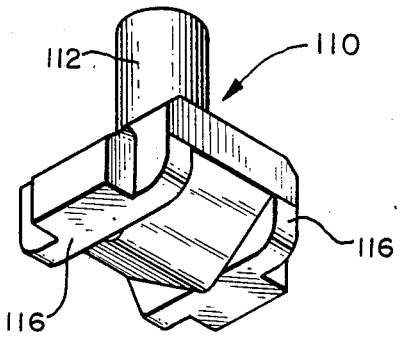
FIG. 4a

SNAP ACTION SWITCH

BACKGROUND OF THE INVENTION

This invention relates generally to snap action electrical switches and in particular to subminiature snap action switches characterized by an actuator lever which causes a coil spring in a pivot bracket assembly to open or close a pair of electrical contacts. Such snap action electrical switches have been used in a variety of applications for many years, one especially successful subminiature snap action switch being disclosed in U.S. Pat. No. 3,141,075, the specification thereof being incorporated herein by reference.

Though snap action switches of the type described have been the subject of wide-spread use for many years, they nonetheless suffer from several drawbacks and deficiencies. For example, due to their relatively small size, and the concomitant difficulty in handling the miniaturized components, they are difficult to manufacture and assemble. This problem is particularly acute in the manufacture of the pivot bracket assembly which typically comprises an important subassembly of snap action switches of the type described. Further, heretofore subminiature snap action switches were especially difficult to assemble unless a substantial amount of the work was tediously done by hand.

It is thus a primary object of this invention to provide an improved snap action electrical switch, and an improved method for manufacturing and assembling such a switch. It is another object of this invention to provide such an improved switch which can be efficiently and reliably manufactured with a minimum amount of time required for the type of tedious hand assembly that was typically required heretofore. Other objects, features and advantages of the invention will become apparent upon reading the accompanying detailed description.

SUMMARY OF THE INVENTION

The various objects of the invention, along with numerous features and advantages, are achieved by providing a pivot bracket assembly for use in a snap action switch comprising a spring, a pivot bracket and a blade. The spring is characterized by an intermediate portion terminating at opposite ends thereof in a pair of hooks. The pivot bracket has hook-receiving member, blade cooperating means, and means defining access to an opening aligned with the hook-receiving member, the opening being adapted to accommodate the intermediate portion of the spring to facilitate attachment of one of the hook portions to the hook-receiving member. The blade has an edge, which is adapted to engage the blade cooperating means, and hook-receiving means for receiving the other one of the hook portions associated with the spring. Thus, the spring permits the blade to be mounted to the pivot bracket with the edge of the blade in pivotable contact with the blade cooperating means of the pivot bracket.

In another aspect of this invention there is provided a method for providing a pivot bracket assembly for a snap-action switch comprising the steps of positioning a pivot bracket assembly into a mounting fixture, the pivot bracket assembly being characterized by a first hook-receiving means, a front member defining an opening aligned with the first hook-receiving means, and means providing access to the opening; positioning a blade, characterized by a second hook-receiving means, into the mounting fixture; providing a spring characterized by an intermediate portion and a pair of hook portions extending from opposite ends of the intermediate portion; and moving the spring through the access into the opening and stretching the intermediate portion to engage one of the hook portions with the first hook-receiving means and the other of the hook portions with the second hook-receiving means.

BRIEF DESCRIPTION OF THE DRAWINGS

An exemplary embodiment of the invention summarized above is shown in the accompanying drawings wherein:

FIG. 4 is an enlarged perspective view of some of the components comprising the switch shown in FIG. 1;

FIG. 4A is an enlarged view, taken from a different perspective, of one of the components of the switch shown in FIG. 4;

FIG. 5 is an enlarged perspective view of yet other components of the switch shown in FIG. 1;

DETAILED DESCRIPTION OF AN EXEMPLARY EMBODIMENT OF THE INVENTION

Figure 1:
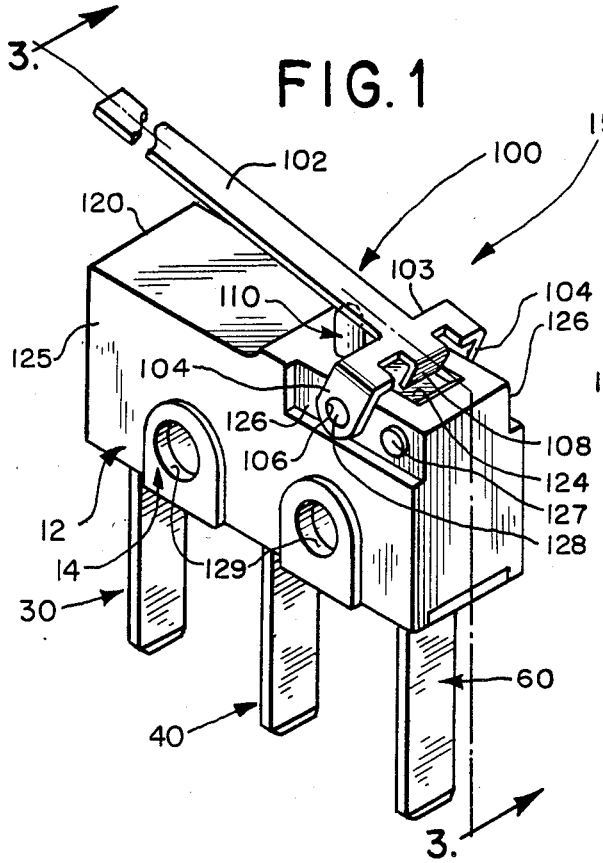
FIG. 1 is an enlarged perspective view of a snap action switch embodying the present invention.
Figure 2:
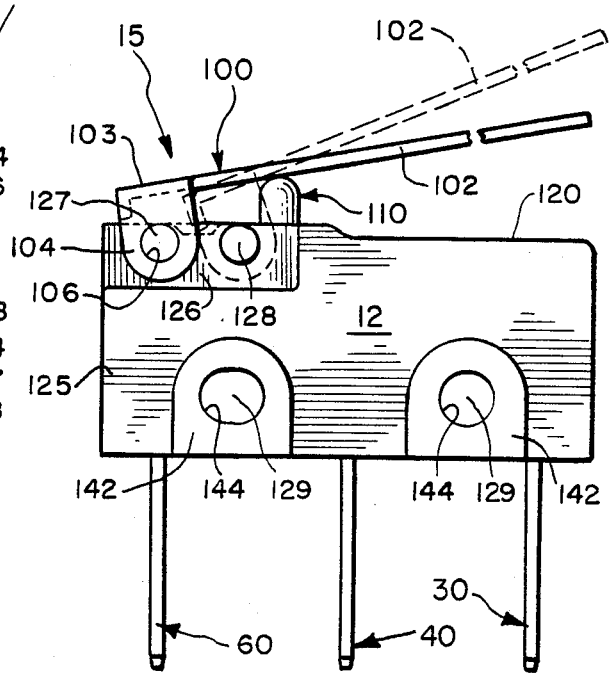
FIG. 2 is a side view of the switch shown in FIG. 1.
Figure 3:
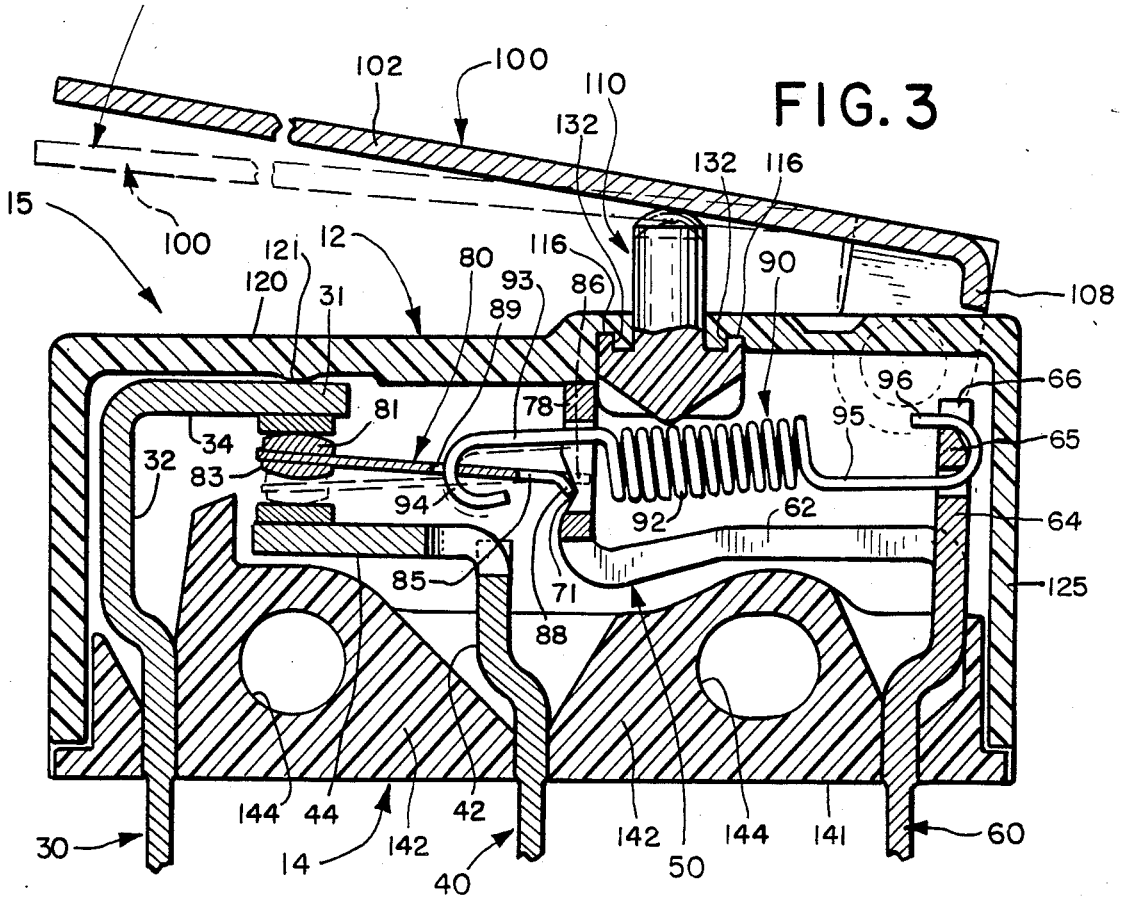
FIG. 3 is an enlarged sectional view, partially cut-a-way, of the switch shown in FIG. 1 taken along lines 3—3 of FIG. 1.

An exemplary embodiment of the sub-miniature snap action switch of the present invention is depicted in FIGS. 1–3. Referring to those figures a snap action switch 15 is shown to include a cover 12 and a base 14. In this embodiment cover 12 and base 14 are preferably formed of molded plastic and are adapted to snap together to enclose a substantially dust-free space for housing the essential components of switch 15. For double throw operation of switch 15, these components preferably include a normally closed contact member 30, a normally open contact member 40, and a pivot bracket assembly 50. As shown in FIG. 4, pivot bracket assembly 50 comprises a pivot bracket 60, a blade 80, and a spring 90.

Switch 15 further includes an actuator 100 and a button 110. As explained in greater detail hereinafter, these various components are typically configured so that, upon operation of switch 15 actuator 100 is forced against button 110 which is, in turn, urged against spring 90 (FIG. 3) of pivot bracket assembly 50. This causes blade 80 to move from a first position wherein it is in electrical contact with normally closed contact member 30, to a second position wherein it is in electrical contact with normally open contact member 40.

The construction of pivot bracket assembly 50 can be better understood by referring to FIG. 4. More particularly, the pivot bracket 60 of pivot bracket assembly 50 is shown to include a pair of spaced arms 62 extending substantially horizontally, arms 62 terminating at one end in a rear plate 64 and at the other end in a forward plate 74. Extending downwardly from rear plate 64 is a terminal 67 which, when switch 15 is mounted for use, may engage a supply or reference potential for alternately coupling such supply or reference to either normally closed contact member 30 or normally open contact member 40. If double throw operation is not desired, it should be understood that either normally closed contact member 30 or normally open contact member 40 may be eliminated. For purposes of completeness, however, all further descriptions are based upon configuring switch 15 for double throw operation.

Between rear plate 64 and terminal 67 of pivot bracket 60 there are formed shoulders 79 whose purpose will be explained hereinafter. Extending upwardly from rear plate 64 of pivot bracket 60 is a rear vertical bar 66. A rear horizontal bar 68 defining a neck 65, is cantilevered substantially perpendicularly from rear vertical bar 66. Neck 65 is disposed somewhat above the space defined by spaced apart legs 62 to accommodate spring 90 in a manner explained hereinafter.

Extending upwardly from front plate 74 of pivot bracket 60 is a front vertical bar 76 which terminates in a cantilevered front horizontal bar 78 disposed substantially perpendicularly to front vertical bar 76. A second front vertical bar 77 also extends upwardly from front plate 74, but unlike front vertical bar 76, it is not connected to front horizontal bar 78. In this manner, second front vertical bar 77 and front horizontal bar 78 define an access 73 to an opening 61 defined by front plate 74, front vertical bars 76, 77 and front horizontal bar 78. Opening 61 is preferably aligned with neck 65 to facilitate attachment of spring 90.

Front plate 74 is further characterized by opposing portions 72, each terminating in a substantially flat rest 69. As shown in FIG. 3, the surface of front plate 74 opposite rear plate 64 has a notch 71 formed therein located below front horizontal bar 78, but extending in a direction substantially parallel thereto.

Still referring to FIG. 4, blade 80 of pivot bracket assembly 50 is comprised of a plate 82 having a proximal end 98 and a distal end 99. Disposed at distal end 99, on opposite faces of plate 82, are a first contact 81 and a second contact 83. As explained hereinafter, contact 81 is adapted to engage a contact disposed on normally closed contact member 30 and contact 83 is adapted to engage a contact on normally open contact member 40.

Blade 80 further includes a pair of legs 84 at its proximal end 98. Legs 84, which define a space 85, terminate in a spaced pivoting edge 88 substantially centered between a pair of tangs 86. Plate 80 is further characterized by a central cut-out 89 whose purpose will be explained in connection with the description of spring 90.

Spring 90 is characterized by an intermediate portion preferably in the form of a helical coil 92. Extending from opposite ends of coil 92 is, respectively, a first extension 93 and a second extension 95. Extension 93 terminates in a first hook portion 94 and extension 95 terminates in a second hook portion 96.

In the assembly of pivot bracket assembly 50, the pivot bracket 60 and the blade 80 are preferably positioned in a mounting fixture (not shown). Using a guide pin (not shown) engaging second hook portion 96 of spring 90, second hook portion 96 is hooked about neck 65 of pivot bracket 60 so that coil 92 is substantially aligned above the space defined by arms 62. Extension 93 of spring 90 can then be moved through access 73 so that spring 90 extends through opening 61. Using another guide pin (not shown) engaging first hook portion 94, spring 90 can then be stretched so that the first hook portion 94 can be hooked around the edges of blade 80 defining cut-out 89. This causes edge 88 of blade 80 to be urged into engagement with notch 71 in the front plate 74 of pivot bracket 60, with tangs 86 supported by rests 69. Upon completion of the assembly of pivot bracket assembly 50, the guide pins are removed from hook portions 94, 96. The completed assembly of pivot bracket assembly 50, comprising pivot bracket 60, blade 80 and spring 90 is shown in FIGS. 3 and 6.

As shown in FIGS. 1–3, switch 15 further includes actuator 100. Actuator 100 includes a lever 102 terminating in a fulcrum portion 103. Fulcrum portion 103 is characterized by a depending flange 108, and a pair of attachment ears 104 each having an ear opening 106. As shown best in FIG. 2, actuator 100 is adapted to be mounted to cover 12 in either a high ratio position or a low ratio position. This is accomplished by alternatively snapping ear openings 106 over a pair of high ratio bosses 128 or a pair of low ratio bosses 127 which are preferably molded into the cover 12.

As previously noted, when switch 15 is operated, actuator 100 is adapted to be forced against button 110. Button 110, best shown in FIGS. 4 and 4A, has a button base 114 from which extends an upwardly protruding member 112, and a pair of peripheral extensions 118. Extending downwardly from button base 114 are a plurality of button legs 116, adapted to captivate coil 92 of spring 90. Thus, when sufficient operating force from actuator 100 is applied to protruding member 112 of button 110, blade 80 of pivot bracket assembly 50 pivots about edge 88 in notch 71, whereby blade 80 is moved out of electrical contact with normally closed contact member 30 and into contact with normally open contact member 40. When such sufficient force is removed, blade 80 returns to its original position, i.e., it is again in electrical contact with normally closed contact member 30, and out of contact with normally open contact member 40.

Figure 6:
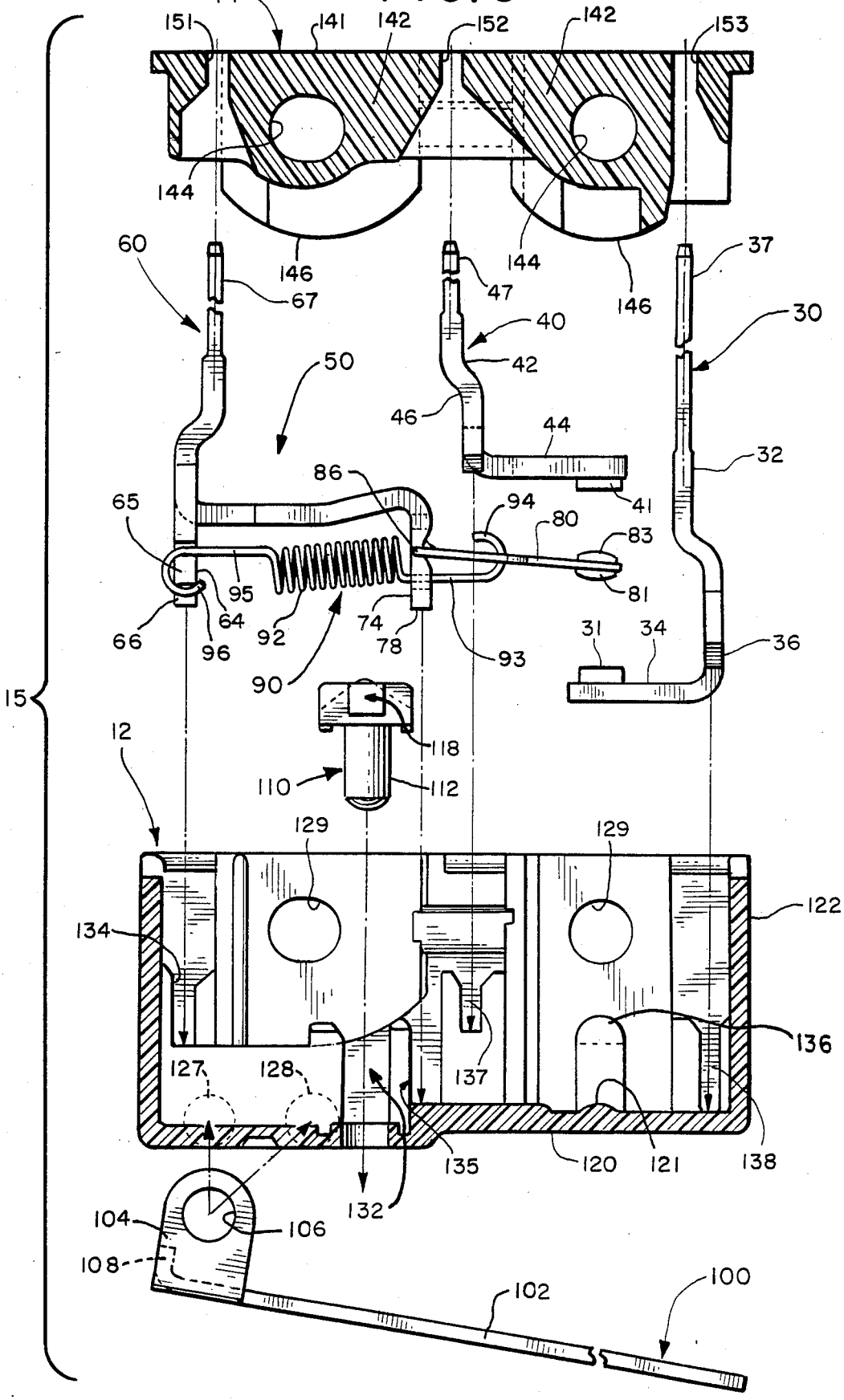
FIG. 6 is an enlarged, exploded view of various ones of the components of the switch shown in FIG. 1, the components being positioned to illustrate an exemplary manner and method of assembling said switch.
Figure 7:
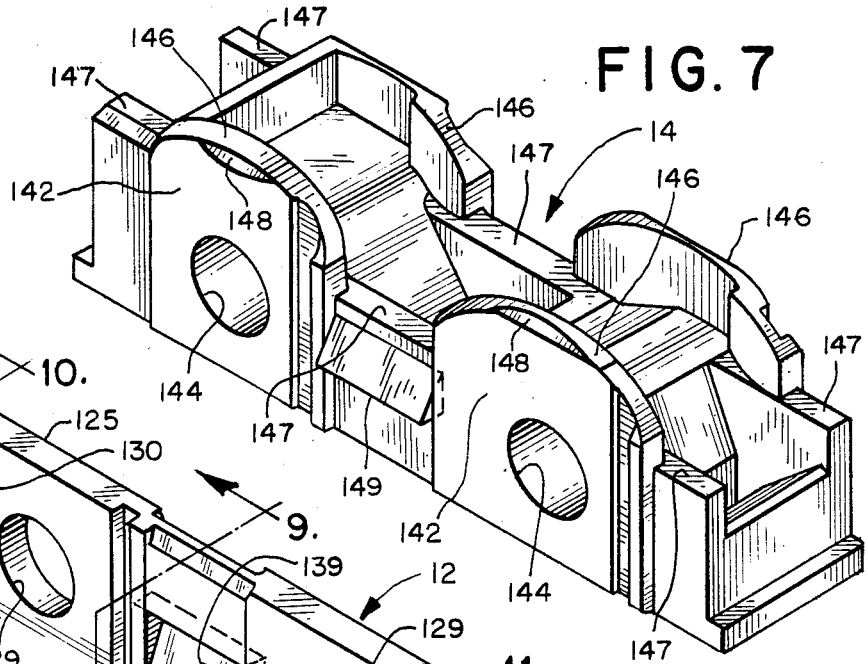
FIG. 7 is an enlarged perspective view of one of the components of the switch shown in FIG. 3.
Figure 8:
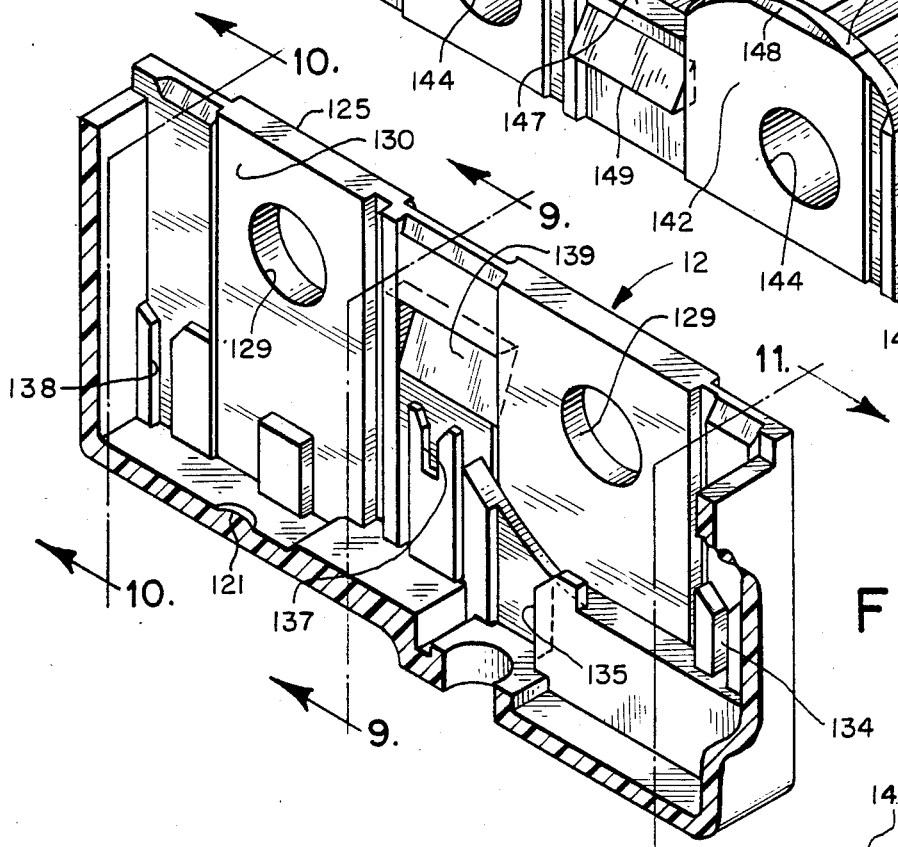
FIG. 8 is an enlarged perspective view, partially cut-a-way, of yet another one of the components of the switch shown in FIG. 3.

Normally closed contact member 30 and normally open contact member 40 are shown best in FIGS. 3, 5 and 6. Normally closed contact member 30 preferably includes a vertical member 32 terminating in a terminal 37 which, when switch 15 is mounted for use, may be electrically connected to means for receiving either supply or reference potential via contact 81 of blade 80. The other end of vertical member 32 terminates in a horizontal member 34 having, on the underside thereof, a contact 31 adapted to be normally engaged with contact 81 on blade 80. Normally closed contact member 30 further includes a pair of protuberances 36 formed on opposite edges of vertical member 32, and shoulders 38 defined by the undersides thereof. The protuberances 36 and the shoulders 38 assist in positioning normally closed contact member 30 in cover 12 during assembly of switch 15.

Normally open contact member 40 is constructed similarly to normally closed contact member 30. Thus, normally open contact member has a vertical member 42 terminating in a terminal 47 which is ordinarily adapted to receive supply or reference potential via contact 83 of blade 80 when switch 15 is mounted for use, and when actuator 100 is operated. Otherwise, normally open contact member 40 is electrically out of contact with blade 80, whereby whatever potential may be applied to contact 83 of blade 80 will not be passed to terminal 47. The other end of vertical member 42 of normally open contact member 40 terminates in a horizontal member 44 which has on the upper side thereof a contact 41. Upon operation of switch 15 in the manner previously described, an appropriate potential is passed to terminal 47 via the engagement of contacts 83 and 41. Normally open contact member 40 further includes a pair of protuberances 46 located at opposite edges of vertical member 42, and shoulders 48 defined by the undersides thereof. Protuberances 46 and shoulders 48 assist in positioning normally open contact member 40 into cover 12 during the assembly of switch 15.

Cover 12 and base 14 of switch 15 are best shown in FIGS. 1–3 and 7 and 8. In FIGS. 1–3, for example, cover 12 is shown to define a substantially hollow shell characterized by four upstanding side walls 125 and a top surface 120. A pair of recesses 126 are formed in two opposing side walls 125 near their junction with top surface 120. Top surface 120 defines a well 124 (FIG. 1) adapted to accommodate flange 108 of actuator 100, thereby permitting the actuator 100 to be mounted for either high ratio or low ratio operation without any modification of either actuator 100 or cover 12. High ratio bosses 128 and low ratio bosses 127 are located within recesses 126 substantially as shown, their purpose and function having been previously explained. A pair of screw openings 129 are defined in each of the opposing side walls containing recesses 126 for purposes of receiving screws (not shown) for mounting the completed switch 15 in position for desired operation if and when such mounting proves necessary. The screws may also provide additional means for holding the elements of switch 15 in place, though such additional holding means are not required in view of the snap together construction of the novel switch 15 described herein.

The interior of cover 12, which illustrates the various mechanical means for facilitating the assembly of switch 15 is shown in FIGS. 3, 6 and 8–11, it being understood that cover 12 is oriented in an upside-down position in FIGS. 6 and 8–11. More particularly, there is shown, as in FIG. 6, extension-receiving notches 132 adapted to receive and guide peripheral extensions 118 of button 110. The interior of cover 12 further includes means defining grooves 134, 135 adapted to receive, respectively, mating components of rear plate 64 and front plate 74 of pivot bracket 60. Similarly, cover 12 is characterized by means 137 for receiving protuberances 46 of normally open contact member 40, and means 138 for receiving protuberances 36 of normally closed contact member 30. Means 137 and 138 guide and position the corresponding protuberances of contact member 30 and 40, thereby establishing them in the desired location inside cover 12. The interior of cover 12 contains a rest 136, and raised projection 121 which serve to locate and secure contact elements during assembly. A wedge receiving notch 139 whose purpose is to cooperate with mating elements of base 14 to form a completed switch assembly is also formed within cover 12.

Figure 9:
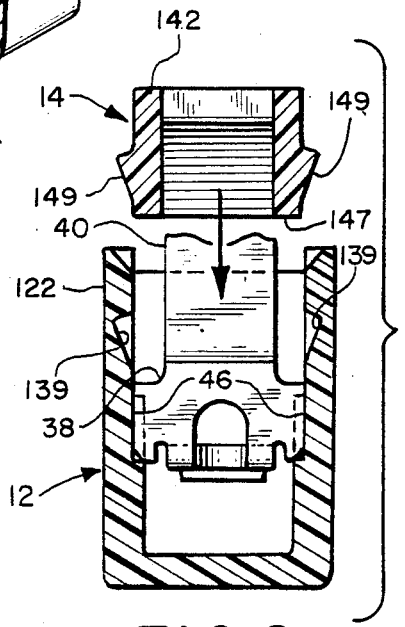
FIG. 9 is an enlarged sectional view of a portion of the switch shown in FIG. 1 taken along lines 9—9 of FIG. 8.

Base 14 is shown in FIGS. 1–3, 6, 7 and 9–11, it being understood that base 14 is oriented in an upside-down position in FIGS. 6, 7 and 9–11. In particular, as shown in FIG. 6, for example, base 14 is characterized by a bottom surface 141 having an opening 151 adapted to accommodate terminal 67 of pivot bracket 60, an opening 152 adapted to accommodate terminal 47 of normally open contact member 40, and an opening 153 adapted to accommodate terminal 37 of normally closed contact member 30. Extending upwardly from bottom surface 141 are a pair of sides 142, each having a pair of screw holes 144 aligned with screw holes 129 in cover 12 when base 14 and cover 12 are fastened together. Each of sides 142 of base 14 is characterized by a rounded edge 146 which acts as a creepage path extender to prevent electrical voltage breakdown between contact members 30, 40 and 60 and switch mounting screws. (Not shown) Between each pair of screw holes 144 in the sides 142 of base 14 there is a wedge element 149, shown best in FIG. 7. As shown in FIG. 9, wedge elements 149 are engagable with the respective wedge receiving notches 139 of cover 12.

Figure 11:
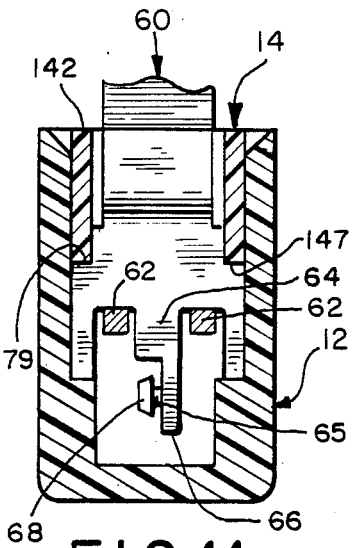
FIG. 11 is an enlarged sectional view of a portion of the switch shown in FIG. 1 taken along lines 11—11 of FIG. 8.
Figure 10:
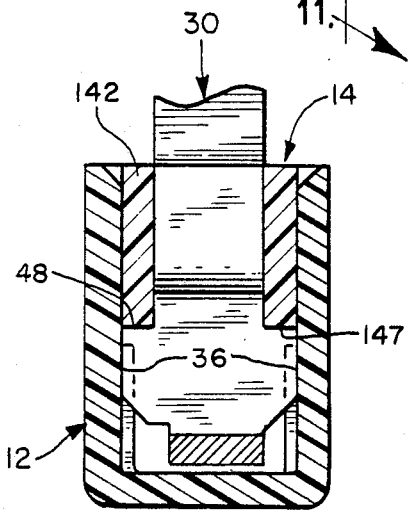
FIG. 10 is an enlarged sectional view of a portion of the switch shown in FIG. 1 taken along lines 10—10 of FIG. 8.

When base 14 is fastened to cover 12, terminals 67, 47 and 37 pass through openings 151, 152 and 153 respectively. Contact members 30, 40 and 60 are secured within the switch 15 as shown in FIGS. 9–11 by edges 147 of sides 142 which press upon shoulders 38, 48 and 79 of contact members 30, 40 and 60 respectively. The cover 12 is secured to base 14 by wedge elements 149 of base 14 which snap into wedge receiving means 139 in cover 12. This results in a secure, stable attachment of cover 12 base 14, and contact members 30, 40, and 60.

The specific method of assembling the various elements comprising switch 15 can now be described, such description being best understood if read in conjunction with FIGS. 6–11. Initially the cover 12 is preferably placed in an assembly fixture (not shown) in an upside down position, whereby top surface 120 is facing down and the sides 122 are facing up. Button 110 is then inserted into cover 12, protruding member 112 first, until peripheral extensions 118 cooperate with extension-receiving notches 132. When this is completed, button 110 is properly seated in cover 12.

The normally closed contact member 30 is then inserted into cover 12 with means 138 guiding and positioning vertical member 32. The pivot bracket assembly 50 may then be assembled in the manner previously described. When so assembled it is inserted into cover 12, terminal 67 up, until mating portions of rear plate 64 and front plate 74 cooperate with means 134, 135, respectively. Assuming a double throw switch is desired, the normally open contact member 30 is inserted into cover 12 in the manner previously described. When button 110, pivot bracket assembly 50 and contact elements 30, 40 are all properly positioned and seated inside cover 12, base 14 is fastened thereto. This is principally accomplished by causing the sides 122 of cover 12 to bow slightly until the wedge elements 149 of base 14 snap into the wedge receiving notches 139 of cover 12.

Uniformity of manufacture is accomplished by cooperation between base 14, cover 12, and contact members 30, 40, and 60. As shown in FIG. 6, contact members 30, 40, and 60 are generally "L" shaped. The internal dimensions of cover 12 and base 14 are such that the contact members are deformed inwardly when base 14 is fully inserted into cover 12. When contact member 30 is inserted into cover 12, horizontal member 34 rests on raised projection 121. Similarly, horizontal member 44 of contact member 40 abuts rest 136. When base 14 is positioned prior to final insertion, base edges 147 contact shoulders 38 and 48. As the base is urged toward its engaged position, it exerts a force on vertical members 32 and 42 of contact members 30 and 40 respectively. Since only the ends of horizontal members 34 and 44 are fixed, these members are deformed inwardly, toward vertical members 32 and 42 respectively. Deformation of contact member 50 occurs as horizontal bar 78 contacts cover 12 and shoulders 79 contact base edges 147. Thus it can be seen when the base is fully engaged, the base 14 and cover 12 locate and secure the contact members in predetermined operational positions, thus facilitating uniformity of manufacture.

Finally, the actuator 100 is fastened to the cover 12 by fitting ears 104 (FIG. 1) over either bosses 127 or 128, depending on whether a low ratio or a high ratio position for lever 102 is desired. The completed switch 15 can then be mounted for use by passing screws through openings 144, 129.

What has been described is a novel snap action switch and a method for assembling such a switch in an efficient and reliable manner. Though the exemplary embodiment of the invention herein disclosed is preferred, numerous modifications and variations which do not part from the true scope of the invention will be apparent to those skilled in the art. Accordingly, all such modifications and variations are intended to be covered by the appended claims.

We claim:

1. A snap action switch comprising:

a first contact member having a horizontal member and a vertical member forming a central angle therebetween, said vertical member having at least one protruding portion extending transversely therefrom;

a pivot bracket assembly including a moveable contact member adapted to be alternately engaged and disengaged with said first contact member upon operation of the switch, said assembly having a horizontal member and a vertical member forming a central angle therebetween, said vertical member having at least one protruding portion extending transversely therefrom;

a cover having means for slidingly receiving the protruding portion of the first contact member and the protruding portion of the pivot bracket assembly, said cover also including means for engaging the horizontal members of said first contact member and said pivot bracket assembly; and a base having means for engaging the protruding portion of said first contact member and the protruding portion of said pivot bracket assembly and, upon insertion of the base into the cover, pressing said contact member and pivot bracket assembly against the engaging means of the cover, causing said contact member and said assembly to be deformed about said central angles into predetermined operational positions.

2. The snap action switch defined in claim 1 further comprising a second contact member adapted to be alternately engaged and disengaged by said moveable contact member, and having a horizontal member and a vertical member forming a central angle therebetween, said vertical member having at least one protruding portion extending transversely therefrom, and wherein said cover includes means for slidingly receiving said protruding portion of said second contact member, and wherein said base includes means for engaging said protruding portion and, upon insertion of the base into the cover, pressing said second contact member against the engaging means of the cover, causing said second contact member to be deformed about said central angle into a predetermined operational position.

3. The snap action switch defined in claim 2 wherein said base includes at least one protrusion, and said cover includes means for receiving and holding said protrusion when the cover and base are pressed together, thereby enabling the base to be mounted to the cover.

4. The snap action switch defined in claim 3 wherein said first and second contact members and said pivot bracket assembly are electrically conductive terminals, and said base includes means for permitting said terminals to pass through said base.

5. The snap action switch defined in claim 1 further comprising an actuator adapted to operate said switch, said actuator including means for mounting said actuator on said cover for either high ratio or low ratio operation.

6. The snap action switch defined in claim 5 wherein said actuator mounting means include attachment ears defining a pair of openings.

7. The snap action switch defined in claim 6 wherein said cover defines two pair of bosses, one pair corresponding to a high ratio operation and the other pair corresponding to a low ratio operation, said attachment ears of said actuator being aligned with said one pair of bosses so that said openings receive said bosses to arrange said switch for high ratio operation, and said attachment ears being aligned with said other pair of bosses so that said openings can receive said bosses to arrange said switch for low ratio operation.

8. The snap action switch defined in claim 5 wherein the actuator mounting means comprise a flange, and wherein said cover has a surface defining a well to accommodate said flange when said actuator is mounted for high ratio operation.

9. The snap action switch defined in claim 5 further comprising a button having an extending member adapted to be contacted by said actuator when said switch is operated.

10. The snap action switch defined in claim 9 wherein said button includes a peripheral extension, and said cover includes means for receiving said extension for holding and maintaining said button in position until the assembly of said switch is completed.

11. A snap action switch comprising:

a plurality of electrically conductive, substantially L-shaped contact elements having vertical and horizontal members, each of said contact elements having at least one protruding portion extending transversely from said vertical member, each of said protruding portions defining a shoulder on the underside thereof;

a substantially L-shaped electrically conductive bracket assembly having a pivotal electrically conductive portion for alternately pivotally engaging said contact elements upon operation of said switch, said bracket assembly having vertical and horizontal members, said vertical member having at least one protruding portion extending transversely therefrom and defining a shoulder on the underside thereof;

a cover having grooves for slidingly receiving and retaining the protruding portion of each of said contact elements and the protruding portion of said bracket assembly to secure said contact elements and said bracket assembly during assembly of said switch, said cover also including means for engaging the horizontal member of each of said contact elements and said pivot bracket assembly; and a base having mating surfaces for engaging the shoulders of said contact elements and bracket assembly and, upon insertion of the base into the cover, pressing said contact elements and said bracket assembly against the engaging means of said cover to deform said contact members and bracket assembly to predetermined operational positions within said switch.

* * * * *